US009112281B2

(12) United States Patent
Bresciani et al.

(10) Patent No.: US 9,112,281 B2
(45) Date of Patent: Aug. 18, 2015

(54) REFLECTOR ARRAY ANTENNA WITH CROSSED POLARIZATION COMPENSATION AND METHOD FOR PRODUCING SUCH AN ANTENNA

(75) Inventors: Daniele Bresciani, Toulouse (FR); Hervé Legay, Plaisance du Touch (FR); Gérard Caille, Tournefeuille (FR); Eric Labiole, Villeneuve Tolosane (FR)

(73) Assignee: THALES, Courbevoie (FR)

( * ) Notice: Subject to any disclaimer, the term of this patent is extended or adjusted under 35 U.S.C. 154(b) by 512 days.

(21) Appl. No.: 13/636,252

(22) PCT Filed: Feb. 11, 2011

(86) PCT No.: PCT/EP2011/052048

§ 371 (c)(1),
(2), (4) Date: Nov. 15, 2012

(87) PCT Pub. No.: WO2011/113650

PCT Pub. Date: Sep. 22, 2011

(65) Prior Publication Data

US 2013/0099990 A1 Apr. 25, 2013

(51) Int. Cl.

| | |
|---|---|
| ***H01Q 19/10*** | (2006.01) |
| ***H01Q 15/24*** | (2006.01) |
| ***H01Q 15/00*** | (2006.01) |
| ***H01Q 15/12*** | (2006.01) |
| ***H01Q 3/46*** | (2006.01) |
| ***H01Q 15/14*** | (2006.01) |

(52) U.S. Cl.

CPC ..... *H01Q 19/10* (2013.01); *H01Q 3/46* (2013.01); *H01Q 15/00* (2013.01); *H01Q 15/006* (2013.01); *H01Q 15/12* (2013.01); *H01Q 15/141* (2013.01); *H01Q 15/24* (2013.01); *Y10T 29/49016* (2015.01)

(58) Field of Classification Search

CPC ..... H01Q 15/00; H01Q 15/12; H01Q 15/24
See application file for complete search history.

(56) References Cited

U.S. PATENT DOCUMENTS 6,081,234 A 6/2000 Huang et al.

OTHER PUBLICATIONS

K.Y. Sze et al.: "Microstrip patches for a reflectarray," Antennas and Propagation Society, 1999. IEEE International Symposium 1999, Orlando, FL, USA, Jul. 11-16, 1999, Piscataway, NJ, USA, IEEE, US, vol. 3, Jul. 11, 1999, pp. 1666-1669, XP010348039.

Ang Yu et al.: "An X-band Circularly Polarized Reflectarray Using Split Square Ring Elements and the Modified Element Rotation Technique," Antennas and Propagation Society International Symposium, 2008. AP-S 2008. IEEE, Piscataway, NJ, USA, Jul. 5, 2008, pp. 1-4, XP031342718.

(Continued)

*Primary Examiner* — Graham Smith
(74) *Attorney, Agent, or Firm* — Baker & Hostetler LLP

(57) ABSTRACT

A reflector array antenna with cross-polarization compensation including at least one radiating element having an etched pattern dissymmetric with respect to at least one direction X and/or Y of the plane XY of the radiating element, the dissymmetry of the pattern of the radiating element being calculated individually on the basis of a radiating element of the same symmetric pattern along the two directions X and Y, so as to engender a reflected wave having a controlled depolarization which opposes a depolarization, engendered in a plane normal to a direction of propagation, by the reflector array illuminated by a primary source.

7 Claims, 12 Drawing Sheets

(56) References Cited

OTHER PUBLICATIONS

L. Marnat et al.: "Accurate Synthesis of a Dual Linearly Polarized Reflectarray," Antennas and Propagation, 2009. EUCAP 2009. 3rd European Conference on, IEEE, Piscataway, NJ, USA, Mar. 23, 2009, pp. 2523-2526, XP031470302.

A. Capozzoli et al.: "Fast Phase-Only Synthesis of Faceted Reflectarrays," Antennas and Propagation, 2009. EUCAP 2009. 3rd European Conference on, IEEE, Piscataway, NJ, USA, Mar. 23, 2009, pp. 1329-1333, XP031470033.

R. Zich et al.: "Frequency response of a new genetically optimized microstrip reflectarray," IEEE Antennas and Propagation Society International Symposium. 2003 Digest. APS. Columbus, OH, Jun. 22-27, 2003; [IEEE Antennas and Propagation Society International Symposium], New York, NY: IEEE, US, vol. 1, Jun. 22, 2003, pp. 173-176, XP010649431.

G. Franceschetti: "Campi Elettromagnetici," Bollati Boringhieri editore s.r.l., Torino 1998 (II edizone), relevant pp. 228-232.

60

| | |
|---|---|
| -0.2dB/45.4° | -29.3dB/-45.2° |
| -29.2dB/-45.2° | -0.2dB/45.6° |

Symmetric element matrix

61

| | |
|---|---|
| -0.1dB/42.9° | -21.1dB/-126° |
| -21.8dB/32.8° | -0.2dB/42.5° |

Desired matrix $$\begin{bmatrix} -0.2\text{dB}/49.3^\circ & -23.3\text{dB}/-116.6^\circ \\ -23.9\text{dB}/37^\circ & -0.2\text{dB}/49.5^\circ \end{bmatrix}$$

Final matrix

REFLECTOR ARRAY ANTENNA WITH CROSSED POLARIZATION COMPENSATION AND METHOD FOR PRODUCING SUCH AN ANTENNA

CROSS-REFERENCE TO RELATED APPLICATIONS

This application is a National Stage of International patent application PCT/EP2011/052048, filed on Feb. 11, 2011, which claims priority to foreign French patent application No. FR 10 01100, filed on Mar. 19, 2010, the disclosures of each of which are incorporated by reference in their entireties.

FIELD OF THE DISCLOSED SUBJECT MATTER

The present invention relates to a reflector array antenna with cross-polarization compensation and a method for producing such an antenna. It applies notably to the antennas mounted on a spacecraft such as a telecommunication satellite or to the antennas of terrestrial terminals for satellite telecommunications or broadcasting systems.

BACKGROUND

Offset antenna configurations comprising a reflector with geometrically shaped surface (in English: offset shaped reflector antenna) and a primary source shifted with respect to the axis normal to the reflector, engender radiations in a cross-polarization induced by the geometric curvature of the reflector and the level of which depends directly on the focal ratio of the reflector, the focal ratio being defined by the ratio of the focal length to the diameter of the reflector. The larger the focal ratio, the lower the level of cross-polarization. However, when the antenna is fitted on an Earth-ward oriented face of a satellite, the structure of the antenna must be compact and the focal ratios are low, thereby inducing a high level of cross-polarization.

In the case of an antenna comprising a reflector illuminated by a centered primary source, the level of cross-polarization is zero in the direction normal to the antenna but there may be axisymmetric cross-polarization lobes due to the curvature of the field lines at the ends of the reflector.

Moreover, the primary source used may, when its performance is low, itself engender field components comprising a cross-polarization.

To meet specifications of low cross-polarization level, satellite-mounted Earth-ward pointing antennas often have a double-reflector structure mounted in a Gregorian configuration. The use of two reflectors makes it possible to define the geometry of the auxiliary reflector with respect to the geometry of the principal reflector in such a way that the cross-polarization induced by the curvature of the auxiliary reflector cancels the cross-polarization induced by the curvature of the principal reflector. However, the presence of the auxiliary reflector and of its support structure gives rise to an increase in the mass, volume and cost of the antenna with respect to an antenna with a single reflector.

Another solution for decreasing the cross-polarization level is to use a reflector array antenna (in English: reflectarray antenna) in an offset configuration. In this type of antenna, a primary source illuminates a reflector array at oblique incidence. The reflector comprises a set of elementary radiating elements assembled into a one- or two-dimensional array and forming a reflecting surface which may be plane. By considering the case where the radiating elements of the antenna are all identical and do not individually induce any cross-polarization, the reflector array then acts as a mirror and the radiation reflected by the reflector array does not comprise any cross-polarization component if it is illuminated by a primary source free of cross-polarization placed on its axis of symmetry. However, the radiating elements of a reflector array generally comprise geometric differences so as to precisely control the phase shift that each radiating element produces on an incident wave. Furthermore, the layout of the elementary radiating elements with respect to one another on the surface of the reflector is generally synthesized and optimized so as to obtain a given radiation diagram in a chosen direction of pointing with a chosen phase law. Consequently, it has been noted that although the reflector is plane and that there is therefore no cross-polarization induced by the curvature of the reflector, on account of the illumination of the reflector by a source in the offset configuration, the reflector array behaves in operation as a reflector with geometrically shaped surface which also induces a cross-polarization radiation whose level is of the same order of magnitude as an equivalent reflector with shaped surface.

SUMMARY

The aim of the invention is to produce a reflector array antenna having a given phase diagram and in which the cross-polarization engendered by a primary source is canceled.

Accordingly, the invention relates to a reflector array antenna with cross-polarization compensation comprising a reflector array consisting of a plurality of elementary radiating elements regularly distributed and forming a reflecting surface and a primary source intended to illuminate the reflector array, the reflector array having a radiation diagram according to two orthogonal principal polarizations in a chosen direction of propagation with a chosen phase law, each elementary radiating element being produced in planar technology and comprising an etched pattern consisting of at least one metallic patch and/or of at least one radiating slot, the metallic patch comprising, in a symmetric configuration, at least four sides that are pairwise opposite with respect to a center of the etched pattern and are disposed parallel to two directions X, Y of the plane XY of the radiating element, the radiating slot comprising, in a symmetric configuration of the radiating element, at least two branches that are diametrically opposite with respect to the center of the etched pattern and are disposed parallel to at least one of the directions X and/or Y of the radiating element. According to the invention, at least one radiating element of the reflector array comprises an etched pattern having a dissymmetric geometric shape with respect to at least one of the directions X and/or Y of the plane XY of the radiating element, the dissymmetry of the etched pattern of the radiating element consisting of an angular inclination of at least one side, respectively of at least one branch, of the geometric shape of the etched pattern with respect to the directions X and/or Y of the plane of the radiating element.

Thus, for each radiating element of the reflector array, the dissymmetry of the etched pattern is calculated individually for each radiating element on the basis of a symmetric radiating element of the same pattern and consists of an angular inclination of at least one direction of the pattern. The angular value of the angle of inclination is determined in such a way that the radiating element engenders a reflected wave having a controlled depolarization which opposes a depolarization engendered in the plane normal to the direction of propagation by the reflector array illuminated by the primary source. The controlled depolarization of the radiating element corresponds to an individual reflection matrix having principal reflection coefficients of amplitude similar to those of the radiating element of the same pattern and of symmetric geometric shape along the two directions X and Y, and cross-reflection coefficients of nonzero amplitude greater than that of said radiating element of the same symmetric pattern.

Advantageously, in the case of an etched pattern comprising a metallic patch and at least two slots etched in the metallic patch in which the slots form at least four principal branches oriented respectively, pairwise, parallel to the directions X and Y in a symmetric configuration of the radiating element, the angular dissymmetries consist of angular rotations of the four principal branches of the slots, around the center of the etched pattern, in the plane XY.

Advantageously, in the case of an etched pattern comprising, in a symmetric configuration, a metallic patch having a square geometric shape, the angular dissymmetries consist of an angular inclination of at least two opposite sides of the metallic patch of the radiating elements in one and the same sense or in opposite senses so as to transform the square shape respectively into a trapezium or into a parallelogram.

Advantageously, several adjacent radiating elements of the reflector array comprise an etched pattern having a dissymmetric geometric shape with respect to at least one direction X and/or Y of the plane XY of each of said radiating elements, the angular inclinations of the side or of the branch of the geometric shape of the etched pattern of each of said radiating elements forming an angle of continuously progressive value from one radiating element to another adjacent radiating element on the reflecting surface.

According to a particular embodiment of the invention, the reflector array comprises several plane facets oriented according to different planes, each plane facet comprising a plurality of elementary radiating elements, and at least one radiating element of each plane facet of the reflector array comprises an etched pattern having a dissymmetric geometric shape with respect to at least one direction X and/or Y of the plane XY of the facet to which the corresponding radiating element belongs.

The invention also relates to a method for producing such a reflector array antenna with offset configuration and cross-polarization compensation consisting in producing a reflector array consisting of a plurality of elementary radiating elements regularly distributed and forming a reflecting surface and in illuminating the reflector array by a primary source. The method consists in making a reflector array in which each elementary radiating element is produced in planar technology and comprises an etched pattern having a geometric shape that is symmetric with respect to two directions X and Y of the plane XY of the radiating element, the etched pattern consisting of at least one metallic patch and/or of at least one radiating slot, and then in introducing a dissymmetry, with respect to at least one of the directions X and/or Y, into the geometric shape of the etched pattern of at least one radiating element of the reflector array, the dissymmetry being calculated on the basis of the radiation diagram of the desired far electromagnetic field in which the cross-polarization is zero and on the basis of the corresponding radiated electric field in the plane of the reflector array.

BRIEF DESCRIPTION OF THE DRAWINGS

Other particular features and advantages of the invention will become clearly apparent in the subsequent description given by way of purely illustrative and nonlimiting example, with reference to the appended schematic drawings which represent.

DETAILED DESCRIPTION

Figure 1:
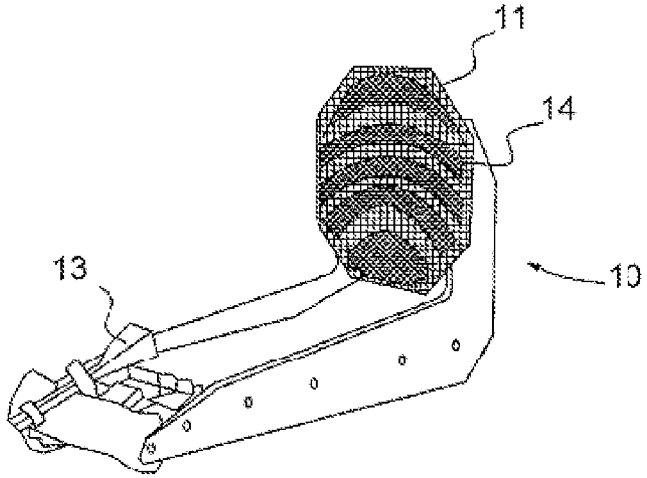
FIG. 1: a diagram of an example of a reflector array antenna, according to the invention.

A reflector array antenna 10 such as represented for example in FIG. 1, comprises a set of elementary radiating elements 20 assembled into a one- or two-dimensional reflector array 11 and forming a reflecting surface 14 making it possible to increase the directivity and the gain of the antenna 10. The reflector array 11 is illuminated by a primary source 13. The elementary radiating elements 20, also called elementary cells, of the reflector array 11, comprise etched patterns of metallic patch and/or slot type. The etched patterns have variable parameters, such as for example the geometric dimensions of the etched patterns (length and width of the "patches" or slots), which are adjusted so as to obtain a chosen radiation diagram. As represented for example in FIG. 2, the elementary radiating elements 20 can consist of metallic patches laden with radiating slots and separated from a metallic ground plane by a typical distance of between $\lambda g/10$ and $\lambda g/4$, where $\lambda g$ is the guided wavelength in the spacer medium. This spacer medium may be a dielectric, but also a composite sandwich produced by a symmetric arrangement of a separator of Honeycomb type and of dielectric skins of slender thicknesses.

Figure 2:
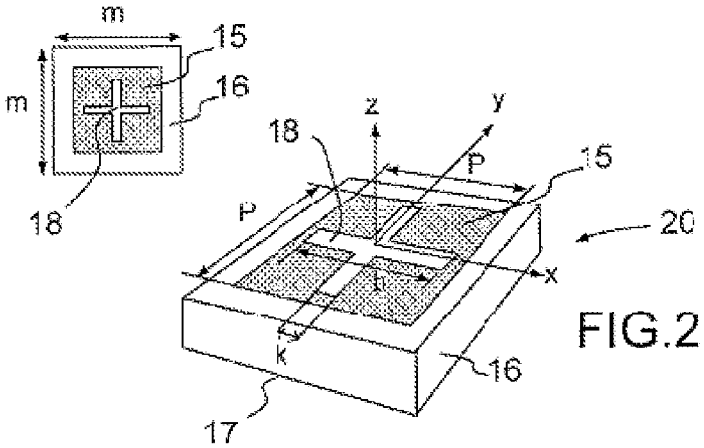
FIG. 2: a diagram of an exemplary elementary radiating element, according to the invention.

In FIG. 2, the elementary radiating element 20 is of square shape having sides of length m, comprising a metallic patch 15 printed on an upper face of a dielectric substrate 16 furnished with a metallic ground plane 17 on its lower face. The metallic patch 15 has a square shape having sides of dimension p and comprises two slots 18 of length b and of width k made in its center, the slots being disposed in the shape of a cross. In a three-dimensional reference frame XYZ, the plane of the reflecting surface of the radiating element is the plane XY. The shape of the elementary radiating elements 20 is not limited to a square, it can also be rectangular, triangular, circular, hexagonal, shaped like a cross, or any other geometric shape. The slots can also be produced in a number different from two and their disposition can be different from a cross. Instead of central slots, the radiating element could also comprise a pattern consisting of a cross-shaped central patch and of one or more peripheral slots. Alternatively, the radiating element could comprise a pattern consisting of several concentric annular metallic patches and of several annular or non-annular slots.

In order for the antenna 10 to be efficacious, it is necessary that the elementary cell can precisely control the phase shift that it produces on an incident wave, for the various frequencies of the passband.

Figure 3:
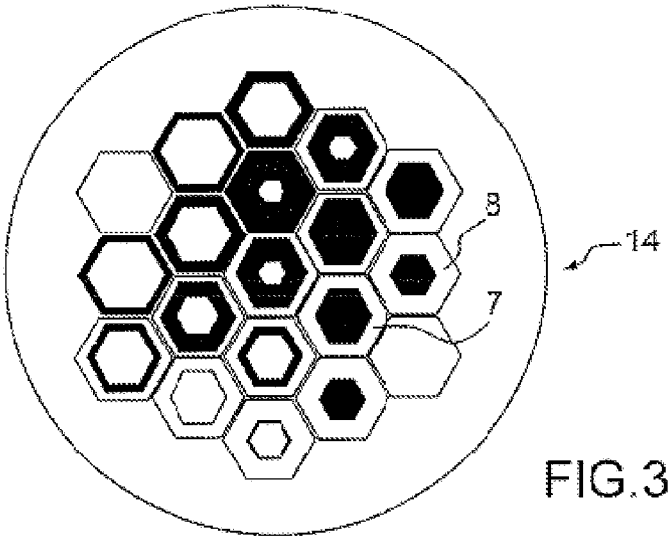
FIG. 3: a diagram of an exemplary arrangement of the radiating elements of a reflector array antenna, according to the invention.

The layout of the elementary radiating elements with respect to one another to constitute a reflector array is synthesized so as to obtain a given radiation diagram in a chosen direction of pointing and with a predetermined phase law. FIG. 3 shows an exemplary arrangement of the radiating elements of a reflector array antenna, making it possible to obtain a directional beam pointing in a lateral direction with respect to the antenna. Because of the planarity of the reflector array and of the differences in path lengths of a wave emitted by a primary source 13 up to each radiating element 7, 8 of the array, the illumination of the reflector array by an incident wave originating from the primary source 13 causes a phase distribution of the electromagnetic field above the reflecting surface 14. The etched patterns of each radiating element 7, 8 therefore have geometric dimensions defined in such a way that the incident wave is reflected by the array 11 with a phase shift which compensates for the relative phase of the incident wave.

The geometric shape of the etched pattern of each radiating element is customarily chosen to be symmetric with respect to the two orthogonal axes X and Y of the plane of each radiating element. An isolated symmetric radiating element hardly depolarizes an incident wave normal to its plane and the associated reflection matrix therefore comprises very low cross-reflection coefficients, generally less than 30 dB. These levels can increase for oblique incidence, particularly greater than 40° with respect to the normal. The radiating elements are laid out on the surface of the reflector so as to produce a specific phase law over the whole surface, in a principal polarization corresponding to the polarization emitted by the primary source. The phenomena of depolarization are phenomena considered to be glitches which impair the performance of the antenna but they are generally not taken into account when producing the layout of the reflector array.

Figure 4A:
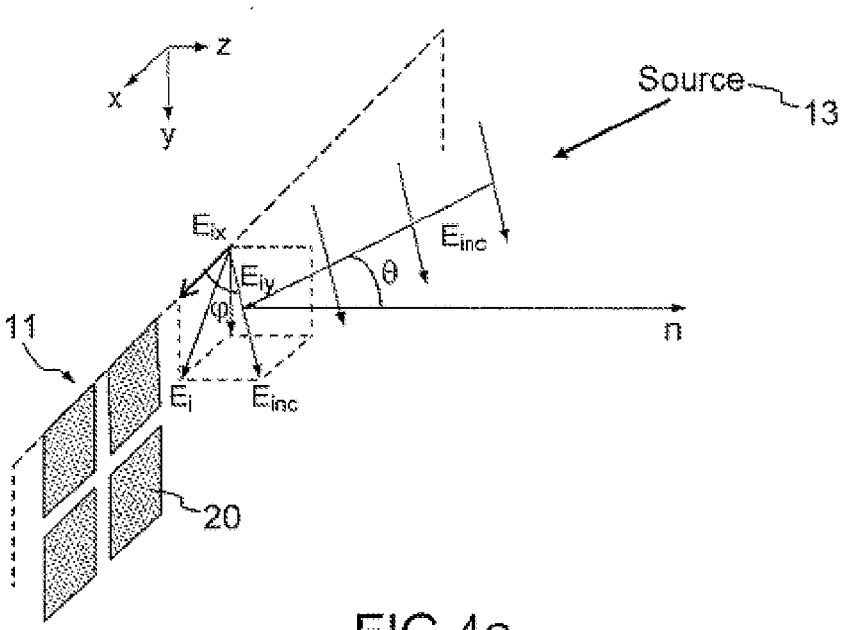
FIG. 4*a*: a diagram illustrating the path of an oblique incident wave on a reflector array, according to the invention.

When the reflector array 11 is illuminated by an oblique incident wave in a linear polarization, it engenders a reflected wave comprising two field components along two orthogonal directions X and Y. In FIG. 4*a*, the surface of the reflector array 11 is partially schematized by dashed lines and four radiating elements 20 are represented, each radiating element 20 comprising a metallic patch of square shape. A primary source 13 placed in the offset configuration illuminates the reflector array 11 along an oblique direction making an angle Θ with respect to the direction n normal to the reflector array 11. The incident electromagnetic field Einc emitted by the primary source may be linearly polarized, for example along a vertical direction in an orthonormal reference frame tied to the source. On account of its oblique incidence, the incident field Einc, linearly polarized in the plane tied to the source, induces, in a reference frame XY tied to the plane of the radiating element, an incident field Ei comprising two field components Eix and Eiy along the two directions X and Y of the plane of the radiating element, the two components Eix and Eiy corresponding to the projection of the oblique incident field Einc in the plane of the reflector array. The reflector array then radiates, along a principal direction of propagation, a reflected electromagnetic field Er comprising two field components Erx and Ery. The incident field Einc linearly polarized in the reference frame tied to the primary source 13 therefore engenders in a plane XY parallel to the plane of the reflector array 11, a cross-polarization field component.

Figure 4B:
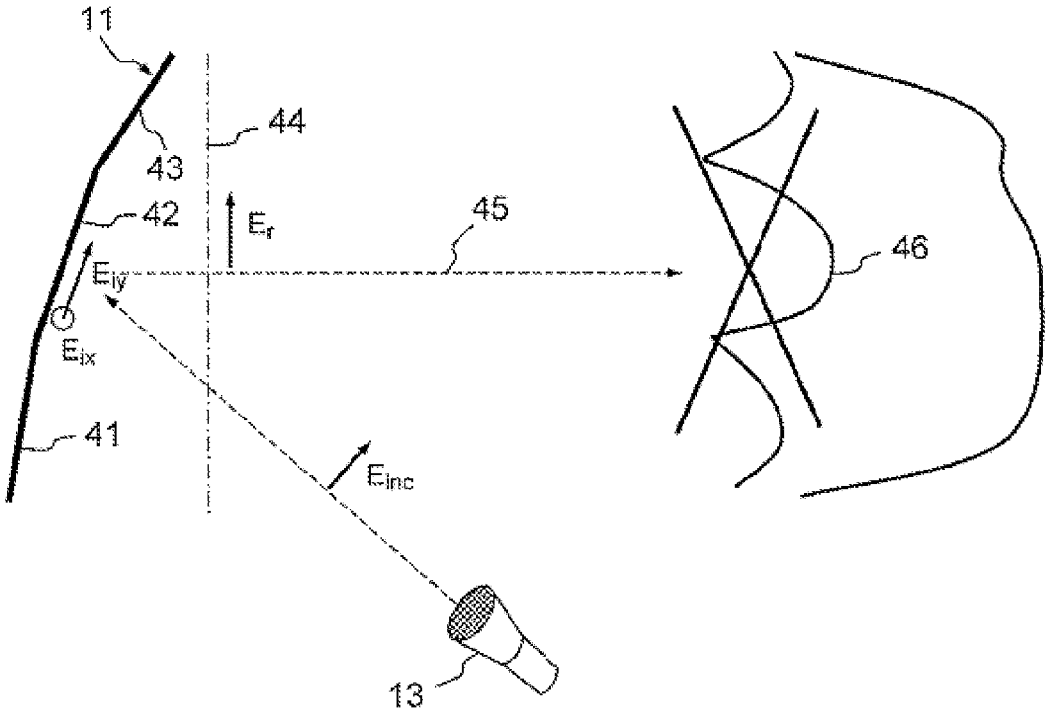
FIG. 4*b*: a diagram illustrating the orientation of the field components in various planes on the path of an incident wave and of a reflected wave, according to the invention.

For a plane reflector array and in the direction n normal to the plane of the reflector array, the cross-polarization components induced at the level of the radiating elements compensate one another. For a phase law imposed so as to produce a beam in a given direction or a specific coverage, as illustrated in FIG. 4*b*, the direction n normal to the plane of the reflector array is generally different from the plane 44 normal to the direction of propagation 45. The cross-polarization components are then summed with a phase weighting and no longer compensate one another.

The invention therefore consists in synthesizing a reflector array in accordance with the prior art, that is to say while worrying only about the radiation diagrams required in the two orthogonal principal polarizations and therefore while being concerned only with the principal reflection coefficients Rxx and Ryy. In order for the radiation diagram of the reflector array to be efficacious, it is important that the principal reflection coefficients Rxx and Ryy have amplitudes close to 1. The invention consists thereafter in slightly disturbing the polarization induced by at least one radiating element of the reflector array so as to compensate for the cross-polarization components induced by the reflector array. The disturbance to be introduced into the radiating elements is determined individually, for each of the radiating elements of the reflector array. The slight depolarization of the waves reflected by each radiating element corresponds to the appearance, in the plane of the reflector array, of a cross-polarization radiation, of small amplitude, at the level of the individual radiating elements. The slight depolarization is such that it makes it possible to obtain, in the plane 44 normal to the direction of propagation 45 of the waves reflected by the reflector array 11, called the aperture plan of the reflector array or radiating aperture plane, an electric field distribution with no cross-component. The depolarization introduced must be small and not disturb the fundamental mode of radiation of the radiating element, nor its phase. For example, the cross-reflection coefficients introduced by each elementary radiating element will preferably be less than −15 dB.

To estimate the amount of depolarization required to be produced on each individual radiating element, the invention consists, in a first step, in defining the radiation diagram of the desired far electromagnetic field 46 and in imposing as starting condition, that the cross-polarization components are zero for this far field. With this far electromagnetic field 46 is associated a unique distribution of a near electromagnetic field on an infinite radiating aperture defined by a plane 44 normal to the direction of propagation 45 of the waves reflected by the reflector array 11. Automatically, the cross-polarization components being zero in the far field, they are also zero in a plane normal to the direction of propagation of the waves reflected by the reflector array and are therefore zero in the aperture plane 44 of the reflector array 11. On the basis of the radiation diagram of the desired far electromagnetic field 46, it is possible to deduce therefrom, by means of a Fourier transform, the components of principal polarization of the corresponding radiated near field, in the aperture plane 44 of the reflector array.

It is also possible to reconstruct the radiated near field on a limited surface corresponding to the reflector array. In order that there may be equivalence between the reconstructed near field and the desired far field, it is necessary for the near field to be confined inside the surface of the reflector array.

In a second step, in the general case where the aperture plane 44 is different from the plane of the reflector array 11, the invention thereafter consists in calculating, by a retro-propagation technique, for each radiating element of the reflector array, the components of the corresponding radiated electric field in the plane of the reflector array. The retro-propagation technique consists of a change of reference frame from the aperture plane 44 to the plane of the reflector array 11. The components of the electric field radiated in the plane of the reflector array are the components Erx and Ery reflected by the corresponding radiating element along the respective directions X and Y. The component Ery is small but nonzero if the plane of the reflector array is different from the aperture plane.

In a third step, the invention consists in calculating the components of the incident electric field Eix and Eiy induced by the primary source 13 on each radiating element of the reflector array. For a primary source of radiating horn type, the horn is defined by a set of spherical wave modal coefficients with which it is possible to calculate the near or far radiated field as described for example in the book by G. Franceschetti, "Campi Elettromagnetici", Bollati Boringhieri editore s.r.l., Torino 1988 (II edizione), incorporated by reference.

In a fourth step, on the basis of the components Erx and Ery determined in the second step and of the components Eix and Eiy determined in the third step, the invention consists, for each radiating element, in deducing therefrom the principal reflection coefficients Rxx and Ryy and the corresponding cross-reflection coefficients Rxy and Ryx.

Indeed, the components Erx and Ery of the reflected field Er that are engendered by the reflector array along the respective directions X and Y are expressed as a function of the components Eix and Eiy of the incident field Ei that is induced by the source by the following equations:

$$Erx=Rxx\ Eix+Rxy\ Eiy$$

$$Ery=Ryx\ Eix+Ryy\ Eiy$$

If the oblique incident wave Einc is polarized in two orthogonal principal directions X and Y, the components of the reflected field that are engendered in the directions X and Y are related to the incident field by two equations for the polarization in the direction X and two additional equations for the polarization in the direction Y.

The reflection matrix of each radiating element of the reflector array therefore comprises coefficients of reflection Rxx in the direction X, Ryy in the direction Y and two cross-reflection coefficients Rxy and Ryx corresponding to a cross-polarization.

In order for the principal reflection coefficients Rxx and Ryy to have amplitudes close to 1, it is necessary for the far radiated field to be very strongly correlated with the near radiated field reconstructed in the virtual plane of the radiating aperture. This is the reason why the invention consists firstly in synthesizing a reflector array while worrying only about the radiation diagrams required in the two orthogonal principal polarizations in the directions X and Y and therefore while being concerned only with the principal reflection coefficients Rxx and Ryy, and then in slightly disturbing the polarization of at least one radiating element so as to compensate for the cross-polarization induced by the reflector array in the direction of propagation of the reflected waves.

By applying this scheme making it possible to estimate the amount of depolarization required to be produced on each individual radiating element, radiating element by radiating element, values of principal and cross-reflection coefficients are deduced for each of the corresponding radiating elements.

Depending on the position of the radiating element 20 on the reflecting surface, the angle of incidence of the wave emitted with respect to this radiating element varies and the cross-reflection coefficients also vary. The depolarization is all the more significant the more the angle Θ of the incident wave with respect to the direction n normal to the reflector array increases.

Thus, for example, in the case of a reflector array 11 consisting of several plane facets, as is represented in FIG. 4*b* where the reflector comprises three plane facets 41, 42, 43 oriented along three different planes, the components Erx and Ery of the radiated field Er must be determined for each radiating element, in the plane XY of the facet to which this radiating element belongs. Various reference frames XY have therefore to be considered depending on the radiating element considered and the facet in which it is situated. The scheme making it possible to estimate the amount of depolarization required to be produced on each individual radiating element must therefore be applied facet by facet so as to reconstruct, according to the scheme presented hereinabove, the components Erx and Ery of the field radiated in the plane XY corresponding to the radiating element considered.

A synthesized reflector array, in accordance with the prior art, while being concerned only with the principal reflection coefficients Rxx and Ryy, generally comprises, for reasons of simplicity of production, radiating elements having an etched pattern symmetric according to their principal axes in the orthogonal directions X and Y of the plane of the reflector array. In the case where the same radiations are required for the two orthogonal polarizations, the radiating elements moreover have identical dimensions in the directions X and Y.

The precise dimensions of the etched patterns of each radiating element are therefore deduced from the principal coefficients Rxx and Ryy. The cross-polarization is in the prior art considered to be sudden, even if artifices have been proposed to limit the effects.

When the components Erx and Ery making it possible to eliminate the cross-polarization have been determined for all the radiating elements of the reflector array, the invention then consists in introducing, into the individual radiating elements 20 of the reflector array 11, a controlled depolarization, differing from one radiating element to another radiating element, making it possible to obtain the entirety of the reflection coefficients corresponding to the desired values. This depolarization introduced individually into the radiating elements is such that it then compensates for the depolarization induced by an oblique incident wave on the final reflector array.

Figure 5A:
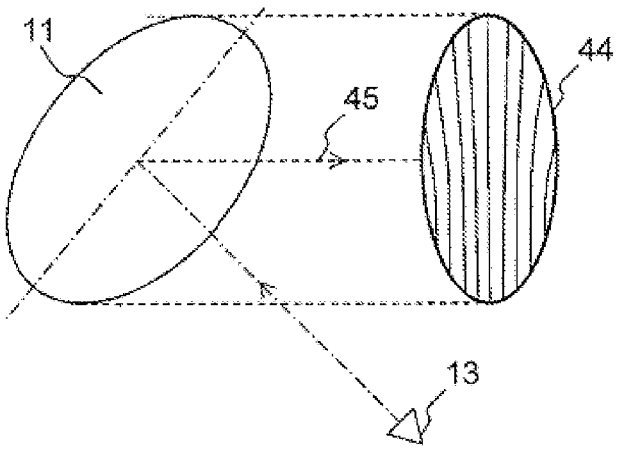
FIGS. 5*a* and 5*b*: two diagrams illustrating the distribution of the electric field in the plane of the radiating aperture in the case where the radiation comprises a cross-polarization component and respectively, in the case where the radiation is perfectly polarized with no cross-component, according to the invention.
Figure 5B:
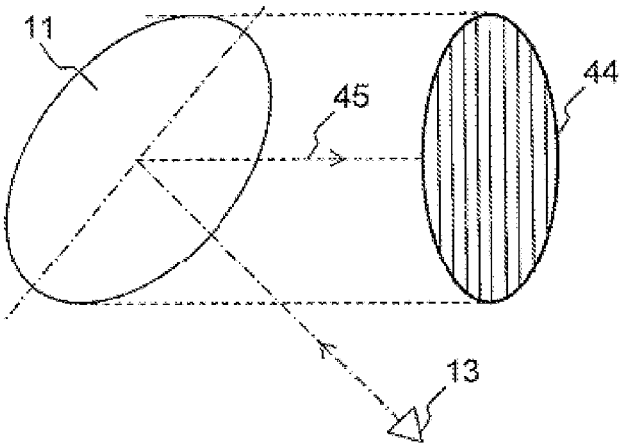

FIG. 5*a* illustrates the distribution of the electric field in the plane of the radiating aperture in the case where the reflector array has been synthesized without taking account of the parasitic glitches related to the cross-polarization and where the radiation comprises a cross-polarization component, and FIG. 5*b* illustrates the case where the reflector array has been synthesized so as to cancel the cross-polarization component and where the radiation is perfectly polarized with no cross-component.

According to the invention, the depolarization introduced into at least one individual radiating element of the reflector array consists in breaking the symmetry of the pattern of this radiating element while preserving the same phase of the principal reflection coefficients induced by this radiating element, so as not to disturb its radiation in the principal polarization. Thus the amplitude and the phase of the cross-reflection coefficients is altered. Accordingly, angular dissymmetries are introduced into the patterns of the radiating elements which engender cross-polarization, it being possible for certain radiating elements not engendering any cross-polarization, for example those situated on the axis of symmetry of the reflector array, to remain symmetric. These angular dissymmetries consist of angular inclinations of at least one principal direction of the pattern or angular rotations of the four principal directions X, X', Y, Y' of the patterns, around the center 50 of the pattern, in the plane XY. The angular rotations are produced with angles which may be different or identical for all the directions and in senses which may be identical or different. When several adjacent radiating elements of the reflector array comprise a pattern having a dissymmetric geometric shape with respect to at least one direction X and/or Y of the plane XY of these radiating elements, the dissymmetry of the pattern of each of said radiating elements is continuously progressive from one radiating element to another adjacent radiating element on the reflecting surface.

Figure 6A:
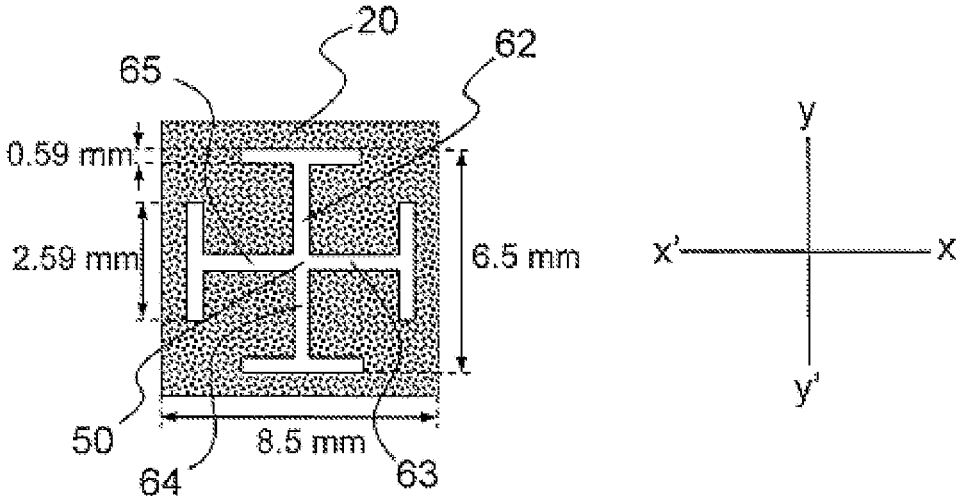
FIG. 6*a*: an exemplary symmetric radiating element comprising a metallic patch and slots etched in the metallic patch, the corresponding reflection matrix and the desired reflection matrix, according to the invention.
Figure 6B:
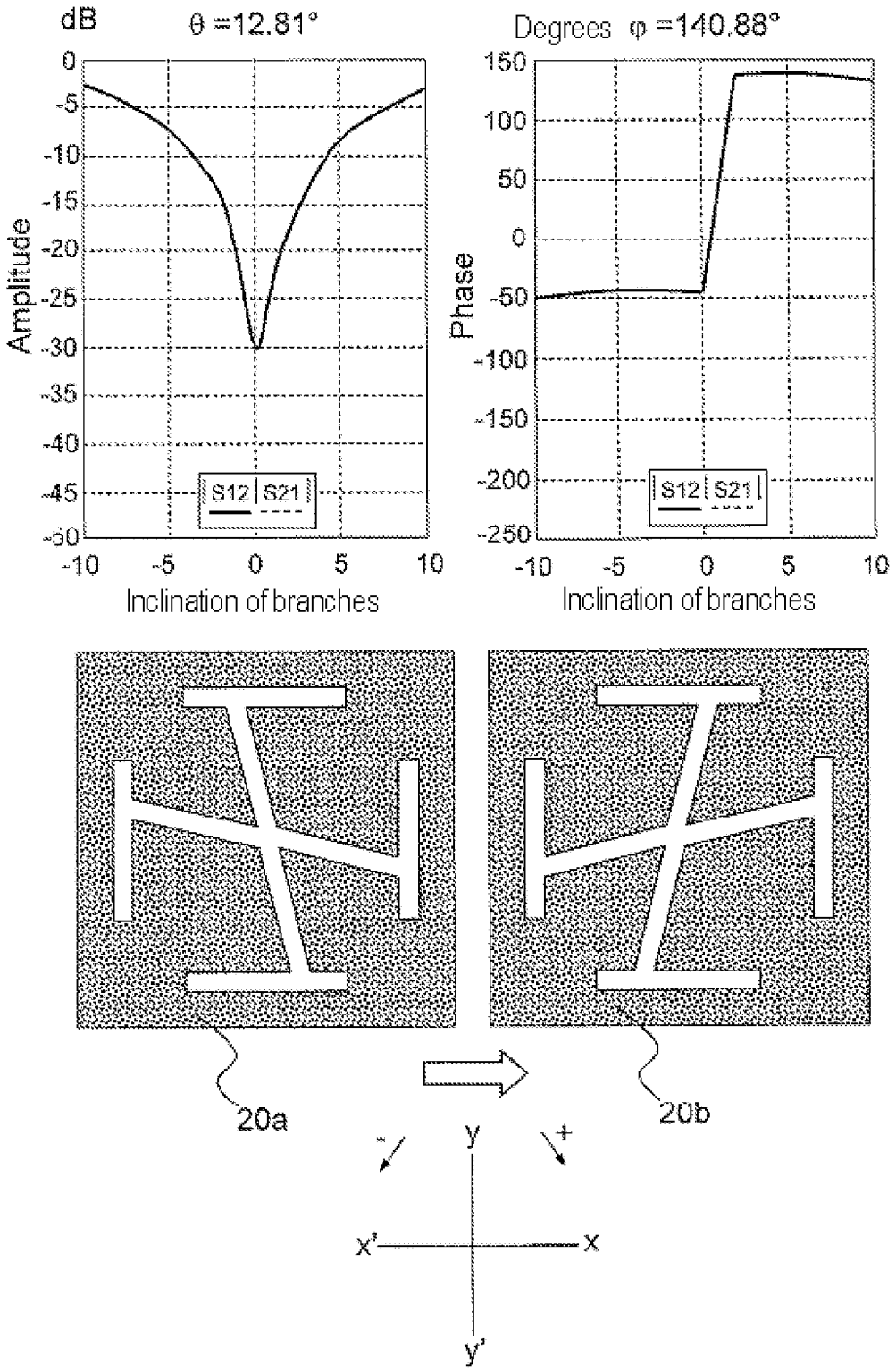
FIGS. 6*b* to 6*e*: the radiating element of FIG. 6*a* in which various types of rotations are introduced and the diagrams relating to the alterations of the amplitude and of the phase of the corresponding cross-coefficients, according to the invention.
Figure 6C:
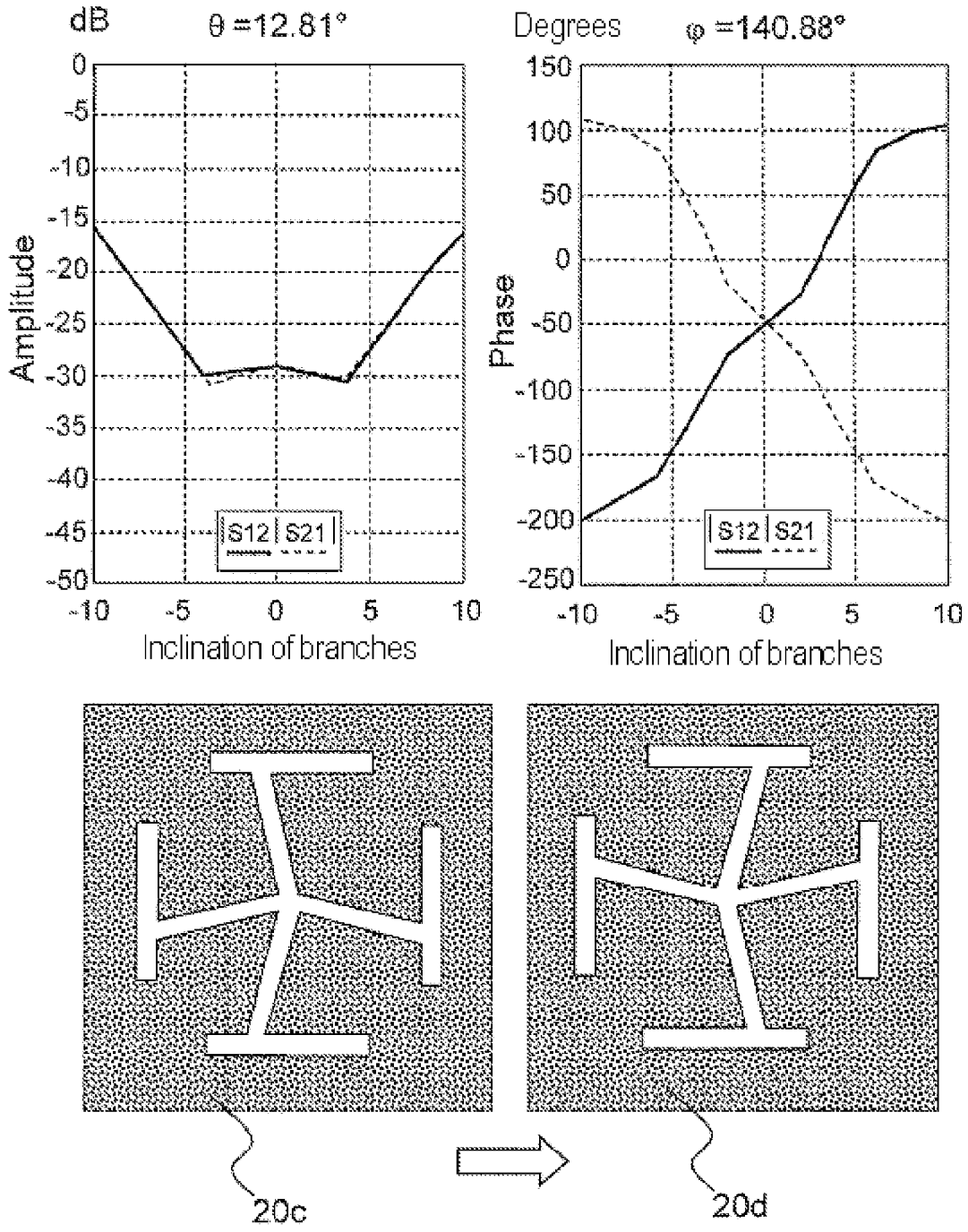
Figure 6D:
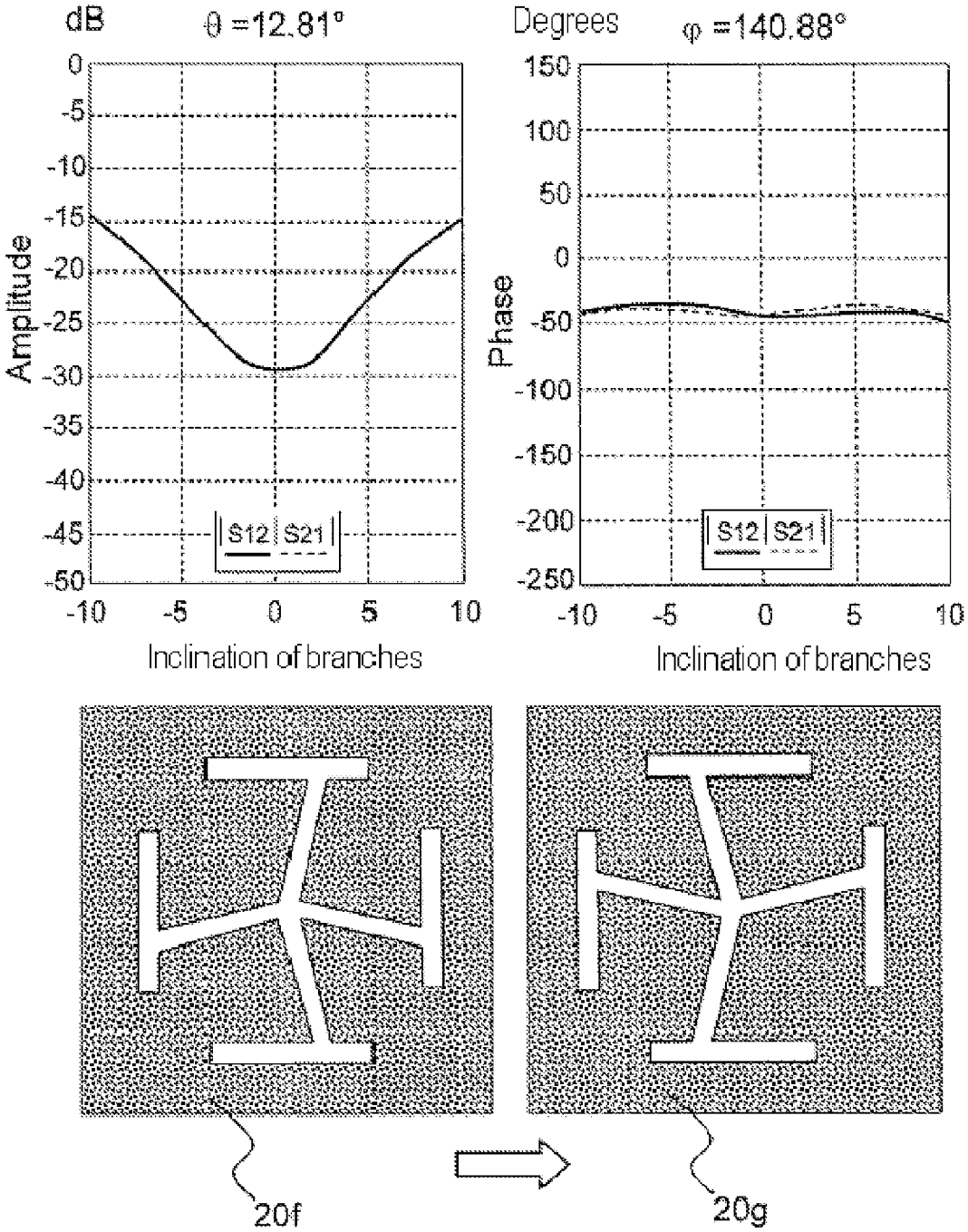

A first example represented in FIGS. 6*a* to 6*d* relates to the case of a radiating element 20 whose geometric pattern comprises a metallic patch and slots etched in the patch. In FIG. 6*a*, the slots form a central cross symmetric according to two orthogonal directions XX' and YY', called a Jerusalem cross. The cross comprises four principal branches 62, 63, 64, 65 that are pairwise opposite and oriented respectively in the directions X, X', Y, Y', each principal branch comprising an end provided with a perpendicular extension. The reflection matrix 60 of this symmetric radiating element is such that the principal reflection coefficients are of equal amplitudes and close to the maximum value 1, corresponding to 0 dB, and the cross-reflection coefficients have very small amplitudes, typically of the order of −29 dB. The desired reflection matrix 61 comprises principal reflection coefficients that are modified very little with respect to those of the symmetric element and slightly degraded cross-reflection coefficients, having an amplitude of the order of −21 dB, this degraded amplitude still lying, however, at a level corresponding to noise. In FIGS. 6*b*, 6*c*, 6*d*, each principal branch of the central cross has undergone various types of angular rotations with respect to the center 50 of the radiating element. The angular rotations consist in modifying the inclination of each of the principal branches, independently of one another, by a different angle and in a positive or negative sense.

In the two configurations 20*a*, 20*b* of FIG. 6*b*, the principal branches of the cross that lie along diametrically opposite directions XX', YY' have been inclined simultaneously, by one and the same angle, the inclination being in a positive sense for two opposite branches and in a negative sense for the other two branches. The amplitude and phase diagrams of the corresponding cross-reflection coefficients show that this configuration has a large impact on the amplitude of the cross-reflection coefficients whereas their phase, modulo 180°, does not alter when the angle of inclination of the principal branches of the cross varies between −10° and +10°.

In the two configurations 20*c*, 20*d* of FIG. 6*c*, the four principal branches of the cross are inclined independently of one another by one and the same angle, the branches lying along diametrically opposite directions being inclined in opposite senses but two successive branches being inclined in one and the same sense. The amplitude and phase diagrams of the corresponding cross-reflection coefficients show that this configuration has little impact on the amplitude of the cross-reflection coefficients when the angle of inclination of the principal branches of the cross varies between −4° and +4° whereas their phase is altered a great deal.

The two configurations 20*f*, 20*g* of FIG. 6*d*, the four principal branches of the cross are inclined independently of one another by one and the same angle, the branches lying along diametrically opposite directions being inclined in opposite senses as in FIG. 6*c* but the sense of inclination of two opposite branches is reversed. The amplitude and phase diagrams of the corresponding cross-reflection coefficients show that this configuration has a great deal of impact on the amplitude of the cross-reflection coefficients when the angle of inclination of the principal branches of the cross varies between −10° and +10° whereas their phase is not altered.

Figure 6E:
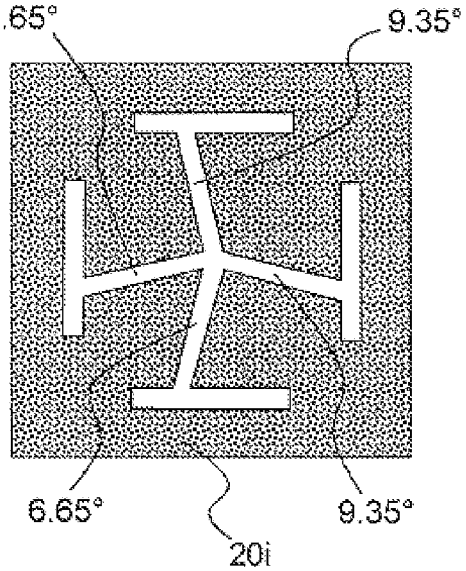

FIG. 6*e* shows an exemplary optimized radiating element 20*i* whose reflection matrix is very close to the desired matrix 61 indicated in FIG. 6*a*. This radiating element 20*i* comprises two branches forming an angle of 9.35° respectively in a negative direction of rotation and in a positive direction of rotation with respect to the directions Y and X, and two branches forming an angle of 6.65° respectively in a negative direction of rotation and in a positive direction of rotation with respect to the directions X' and Y'.

The various examples of rotation of FIGS. 6*a* to 6*e* therefore show that it is possible by adjusting the angle of inclination of the four branches of a cross which are oriented along principal directions of the radiating element, to control the amplitude and the phase of the cross-reflection coefficients and therefore the depolarization of this radiating element.

Figure 7:
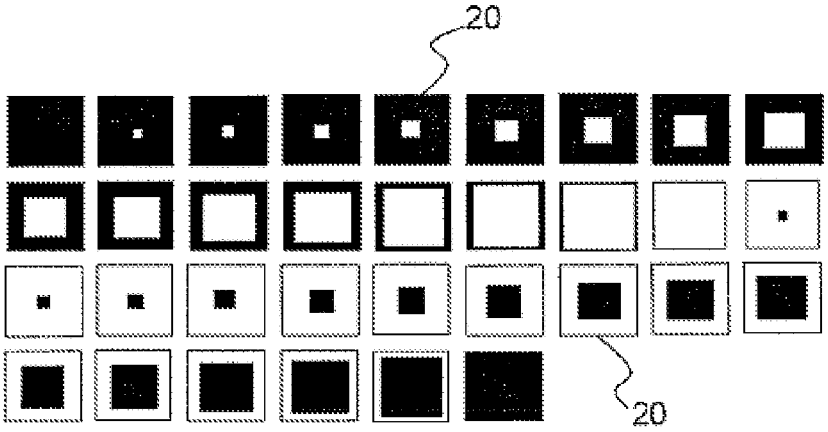
FIG. 7: an example of a set of symmetric successive radiating elements comprising a phase that is continuously alterable between two consecutive radiating elements, each radiating element comprising a pattern consisting of a metallic patch of square shape and of a radiating aperture opened in the metallic patch, according to the invention.

FIG. 7 relates to a set of successive symmetric radiating elements having a phase that is continuously alterable between two consecutive radiating elements, each radiating element 20 comprising a pattern consisting of a metallic patch of square shape and of a radiating aperture opened in the metallic patch. The respective dimensions of the metallic patch with respect to the radiating aperture are continuously alterable from one radiating element to another adjacent radiating element thereby making it possible to have a large number of different phases between 0° and 360°, modulo 360° to be distributed over a reflector array as a function of the desired radiated phase law. The various successive phases are obtained without abrupt rupture of the dimensions of the patch with respect to the radiating aperture thanks to the appearance of the radiating aperture at the center of the metallic patch and to the progressive increase of the dimensions of the radiating aperture until said metallic patch disappears and then to the appearance at the center of the radiating aperture of a new metallic patch whose dimensions increase progressively until the radiating aperture disappears.

Figure 8A:
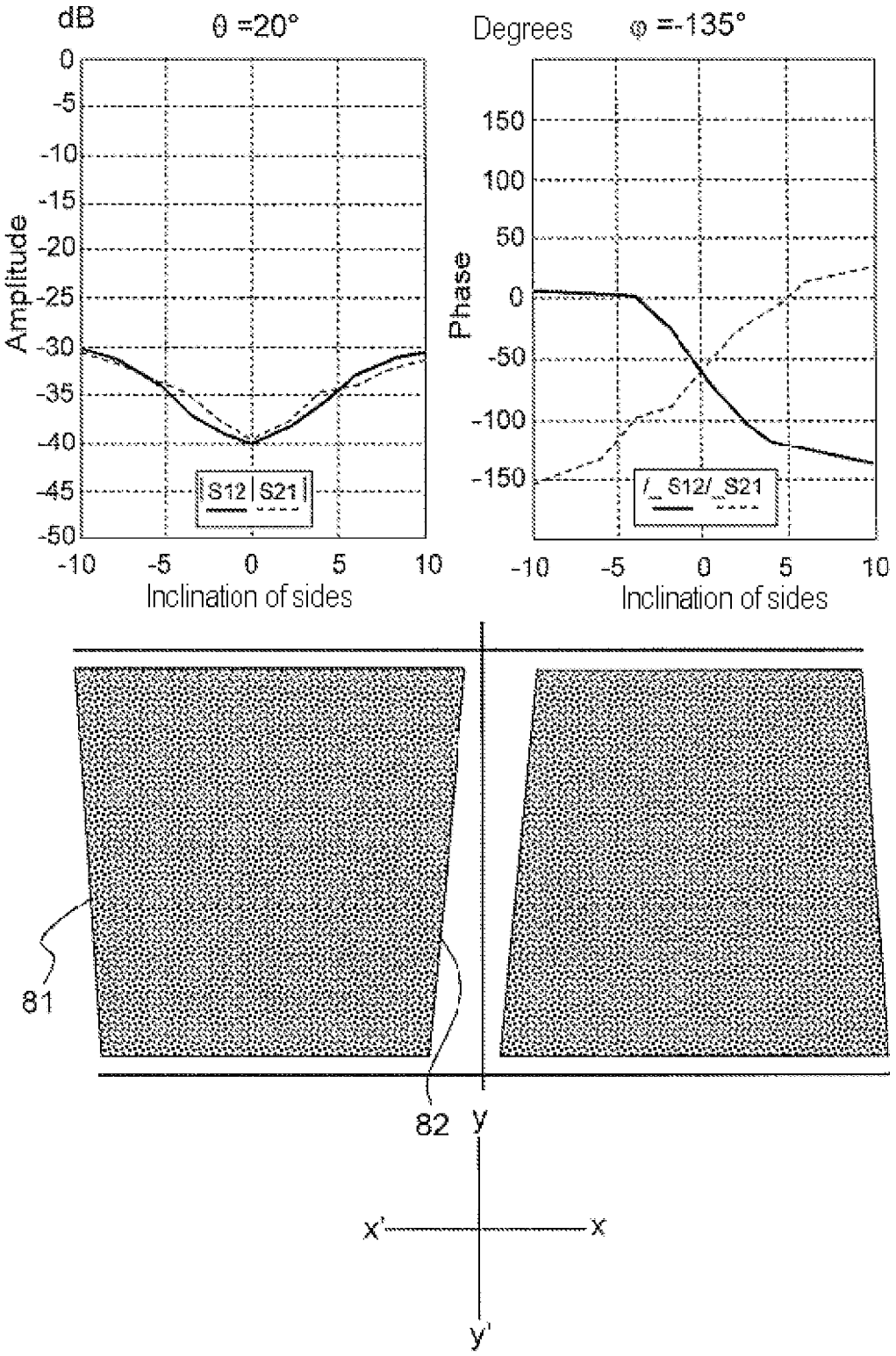
FIGS. 8*a*, 8*b*, 9*a*, 9*b*: a radiating element of FIG. 7, in which various types of rotations are introduced and the diagrams relating to the alterations of the amplitude and of the phase of the corresponding cross-coefficients, according to the invention.
Figure 8B:
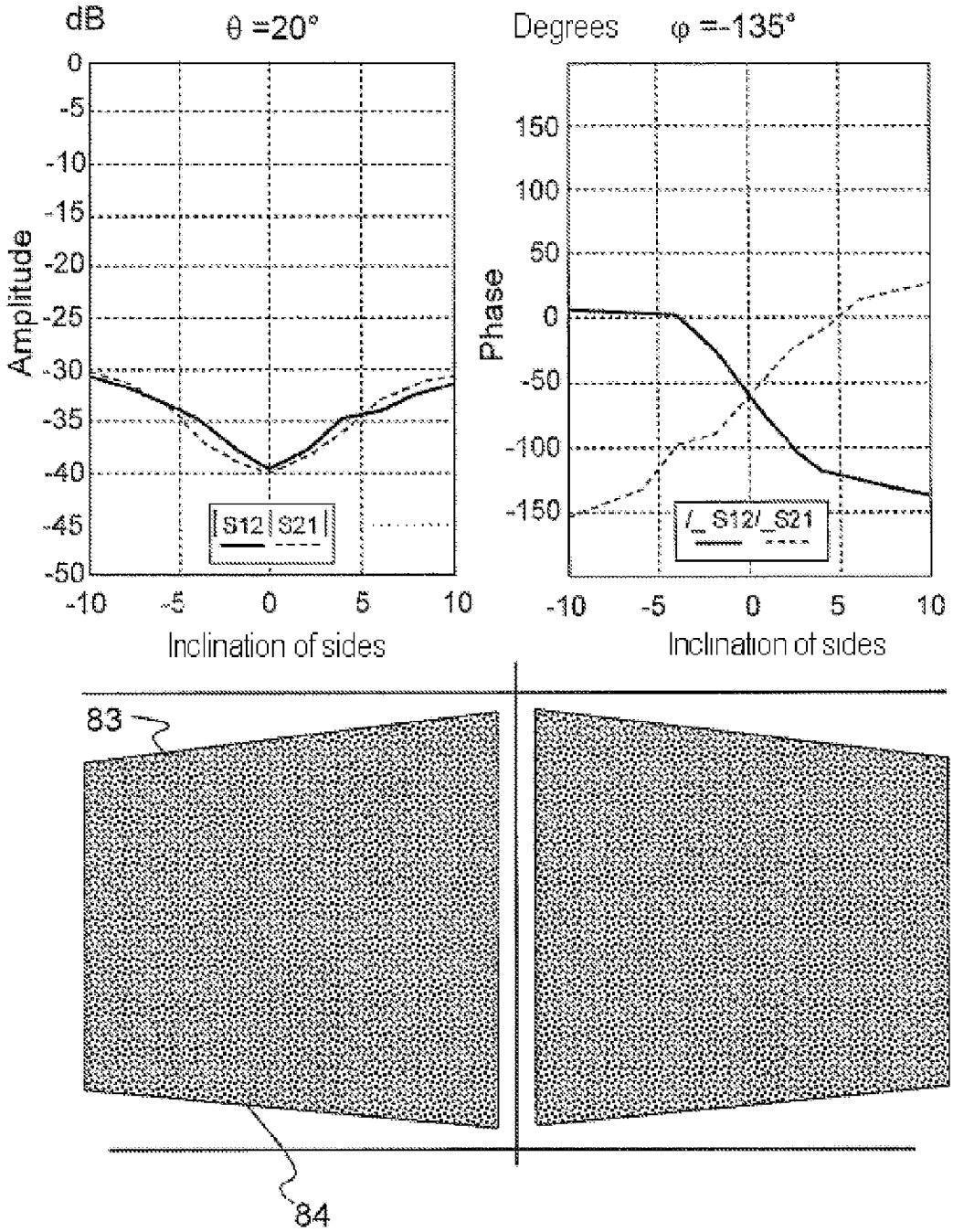

By modifying the angle of inclination of two opposite sides of the metallic patch of each of these radiating elements so as to transform the square shape into a trapezium, it is possible to control the phase of the cross-reflection coefficients of these radiating elements without substantially modifying the principal reflection coefficients. FIGS. 8*a* and 8*b* show the diagrams of the alteration of the phase and of the amplitude of the cross-reflection coefficients for a radiating element subjected to an oblique incident wave and comprising two inclined sides 81, 82 or 83, 84 in opposite directions so as to form a trapezium, the angle of inclination of the sides varying between −10° and +10° with respect to the direction YY' for FIG. 8*a* or with respect to the direction XX' for FIG. 8*b*. In these two figures, the amplitude of the cross-reflection coefficients varies very slightly whereas the phase is altered a great deal.

Figure 9A:
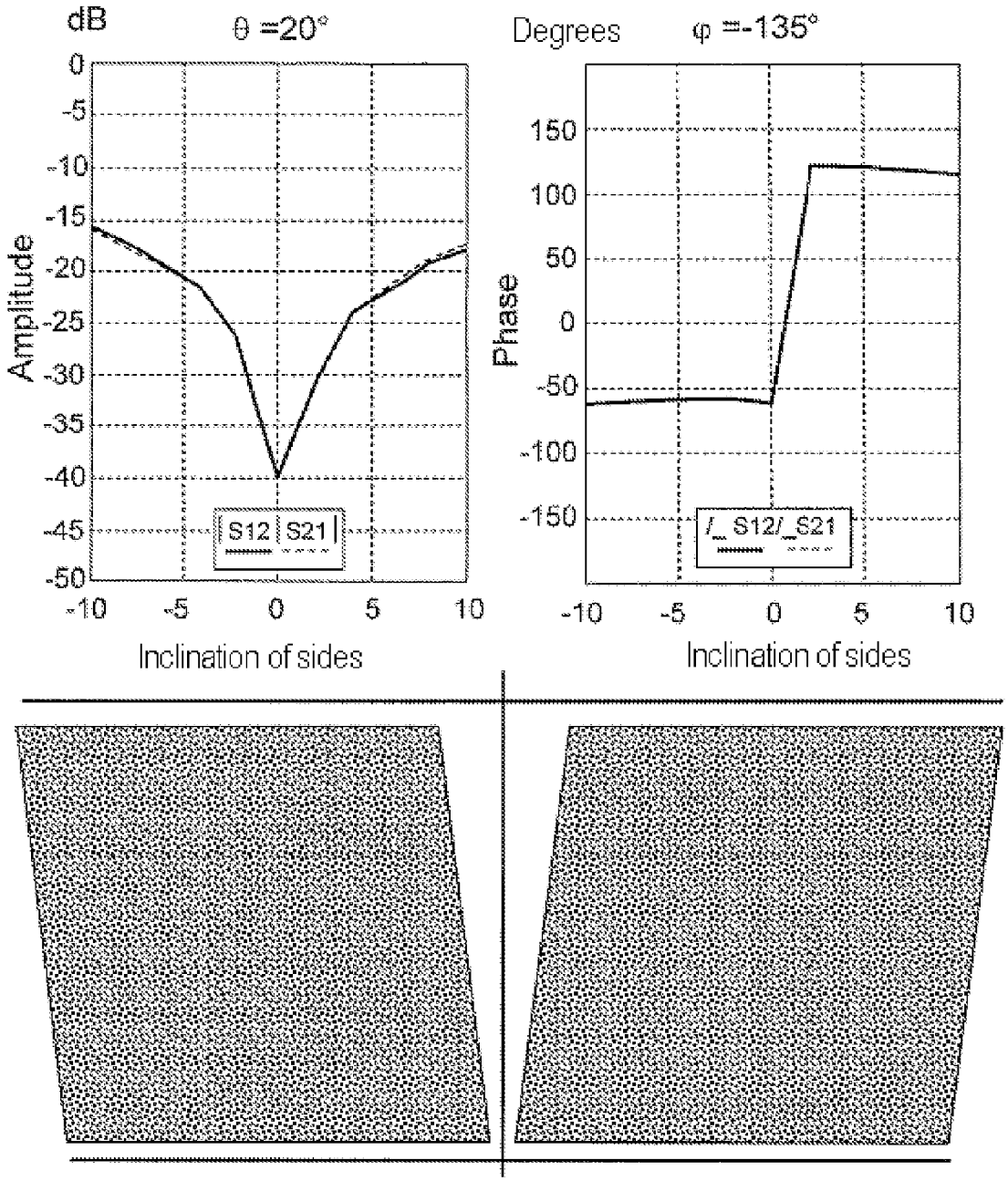
Figure 9B:
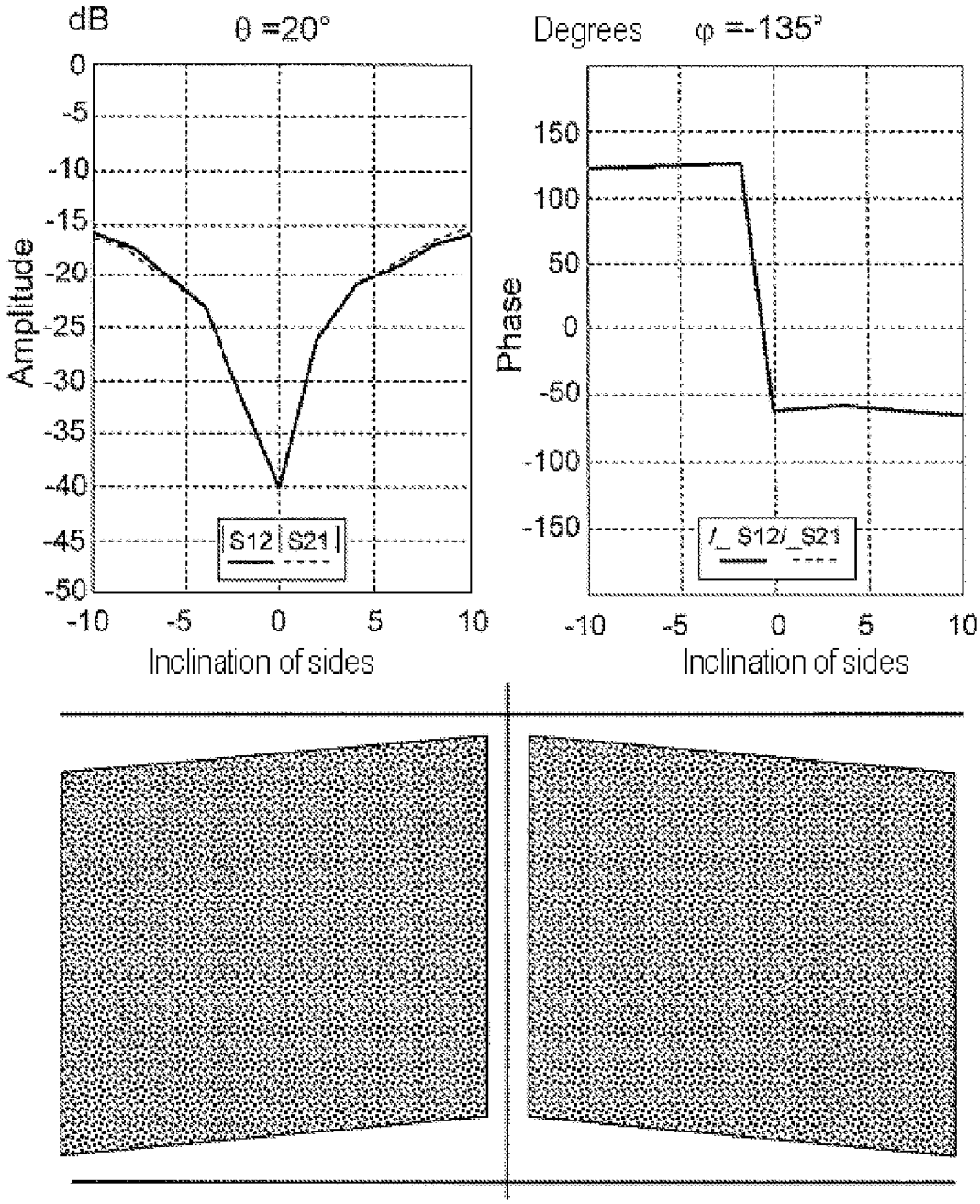

FIGS. 9*a* and 9*b* show other diagrams of the alteration of the phase and of the amplitude of the cross-reflection coefficients when two opposite sides are inclined by one and the same angle in one and the same direction so as to obtain a parallelogram.

Although the invention has been described in conjunction with particular embodiments, it is very obvious that it is in no way limited thereto and that it comprises all the technical equivalents of the means described as well as their combinations if the latter enter into the framework of the invention.

The invention claimed is:

1. A reflector array antenna with cross-polarization compensation comprising a reflector array consisting of a plurality of elementary radiating elements regularly distributed and forming a reflecting surface; and a primary source intended to illuminate the reflector array; wherein the reflector array having a radiation diagram according to two orthogonal principal polarizations in a chosen direction of propagation with a chosen phase law;

each elementary radiating element has been produced in planar technology and comprises an etched pattern consisting of at least one metallic patch and/or of at least one radiating slot, the metallic patch comprising, in a symmetric configuration, at least four sides that are pairwise opposite with respect to a center of the etched pattern and are disposed parallel to two directions X, Y of the plane XY of the radiating element, and the radiating slot comprising, in a symmetric configuration of the radiating element, at least two branches that are diametrically opposite with respect to the center of the etched pattern and are disposed parallel to at least one of the directions X and/or Y of the radiating element; and at least one radiating element of the reflector array comprises an etched pattern having a dissymmetric geometric shape with respect to at least one of the directions X and/or Y of the plane XY of the radiating element, the dissymmetry of the etched pattern of the radiating element consisting of an angular inclination of at least one side, respectively of at least one branch, of the geometric shape of the etched pattern with respect to the directions X and/or Y of the plane of the radiating element.

2. The antenna as claimed in claim 1, wherein an etched pattern comprises a metallic patch and at least two slots etched in the metallic patch, the slots forming at least four principal branches oriented respectively, pairwise, parallel to the directions X and Y in a symmetric configuration of the radiating element, the angular dissymmetries consist of angular rotations of the four principal branches of the slots, around the center of the etched pattern, in the plane XY.

3. The antenna as claimed in claim 1, wherein an etched pattern comprises, in a symmetric configuration, a metallic patch having a square geometric shape, the angular dissymmetries consist of an angular inclination of at least two opposite sides of the metallic patch of the radiating elements in one and the same sense or in opposite senses so as to transform the square shape respectively into a trapezium or into a parallelogram.

4. The antenna as claimed in claim 1, wherein several adjacent radiating elements of the reflector array comprise an etched pattern having a dissymmetric geometric shape with respect to at least one direction X and/or Y of the plane XY of each of said radiating elements, the angular inclinations of the side or of the branch of the geometric shape of the etched pattern of each of said radiating elements forming an angle of continuously progressive value from one radiating element to another adjacent radiating element on the reflecting surface.

5. The antenna as claimed in claim 1, wherein the reflector array comprises several plane facets oriented according to different planes, each plane facet comprising a plurality of elementary radiating elements, and at least one radiating element of each plane facet of the reflector array comprises an etched pattern having a dissymmetric geometric shape with respect to at least one direction X and/or Y of the plane XY of the facet to which the corresponding radiating element belongs.

6. A method for producing a reflector array antenna with cross-polarization compensation comprising:

producing a reflector array consisting of a plurality of elementary radiating elements regularly distributed and forming a reflecting surface;

illuminating the reflector array by a primary source;

producing each elementary radiating element in planar technology and comprising an etched pattern having a geometric shape that is symmetric with respect to two directions X and Y of the plane XY of the radiating element, the etched pattern consisting of at least one metallic patch and/or of at least one radiating slot;

introducing a dissymmetry, with respect to at least one of the directions X and/or Y, into the geometric shape of the etched pattern of at least one radiating element of the reflector array; and calculating the dissymmetry on the basis of the radiation diagram of the desired far electromagnetic field in which the cross-polarization is zero and on the basis of the corresponding radiated electric field in the plane of the reflector array.

7. The method as claimed in claim 6, wherein the calculating the dissymmetry to be introduced into the radiating element comprises:

deducing, on the basis of the radiation diagram of the desired far electromagnetic field in which the cross-polarization is zero, the principal and cross-polarization components of the radiated electric field Er in the plane normal to the direction of propagation of the waves reflected by the reflector array;

calculating, for each radiating element of the reflector array, the components Erx and Ery of the corresponding radiated electric field in the plane of the reflector array;

calculating the components Eix and Eiy of the incident electric field Ei induced by the primary source on each radiating element of the reflector array; and on the basis of the calculated components Erx, Ery, Eix and Eiy, deducing therefrom values of desired principal reflection coefficients Rxx, Ryy and cross-reflection coefficients Rxy, Ryx which must be induced by the corresponding dissymmetric radiating element.

* * * * *

UNITED STATES PATENT AND TRADEMARK OFFICE

CERTIFICATE OF CORRECTION

PATENT NO. : 9,112,281 B2
APPLICATION NO. : 13/636252
DATED : August 18, 2015
INVENTOR(S) : Bresciani et al.

It is certified that error appears in the above-identified patent and that said Letters Patent is hereby corrected as shown below:

Title Page

Please insert the foreign priority information as follows:

-- (30) Foreign Application Priority Data

Mar. 19, 2010 (FR) ..... 10 01100 --

Signed and Sealed this
Nineteenth Day of April, 2016

Michelle K. Lee

Michelle K. Lee
*Director of the United States Patent and Trademark Office*